US006544391B1

(12) United States Patent
Peace

(10) Patent No.: US 6,544,391 B1
(45) Date of Patent: Apr. 8, 2003

(54) REACTOR FOR ELECTROCHEMICALLY PROCESSING A MICROELECTRONIC WORKPIECE INCLUDING IMPROVED ELECTRODE ASSEMBLY

(75) Inventor: Steven L. Peace, Whitefish, MT (US)

(73) Assignee: Semitool, Inc., Kalispell, MT (US)

( * ) Notice: Subject to any disclaimer, the term of this patent is extended or adjusted under 35 U.S.C. 154(b) by 0 days.

(21) Appl. No.: 09/690,856

(22) Filed: Oct. 17, 2000

(51) Int. Cl.[7] ..... C25D 17/00; C25B 9/00; C25B 11/00; C25B 11/04

(52) U.S. Cl. ..... 204/198; 204/212; 204/275.1; 204/284; 204/290.01; 204/292; 204/280

(58) Field of Search ..... 204/275.1, 284, 204/224 R, 198, 212, 290.01, 292, 280

(56) References Cited

U.S. PATENT DOCUMENTS

| | | | | |
|---|---|---|---|---|
| 4,113,577 | A | | 9/1978 | Ross et al. |
| 4,304,641 | A | | 12/1981 | Grandia et al. |
| 4,308,122 | A | | 12/1981 | Das Gupta et al. |
| 4,469,566 | A | | 9/1984 | Wray |
| 4,514,266 | A | | 4/1985 | Cole et al. |
| 4,890,727 | A | | 1/1990 | Downing et al. |
| 5,169,408 | A | | 12/1992 | Biggerstaff et al. |
| 5,227,041 | A | | 7/1993 | Brogden et al. |
| 5,514,258 | A | | 5/1996 | Brinket et al. |
| 5,683,564 | A | | 11/1997 | Reynolds |
| 5,731,678 | A | | 3/1998 | Zila et al. |
| 5,804,043 | A | | 9/1998 | Ikegaya |
| 5,985,126 | A | | 11/1999 | Bleck et al. |
| 6,001,235 | A | | 12/1999 | Arken et al. |
| 6,080,288 | A | | 6/2000 | Schwartz et al. |
| 6,103,085 | A | | 8/2000 | Woo et al. |
| 6,113,759 | A | * | 9/2000 | Uzoh ..... 204/224 R X |
| 6,228,232 | B1 | | 5/2001 | Woodruff et al. |
| 6,251,251 | B1 | * | 6/2001 | Uzoh et al. ..... 204/224 R X |
| 6,254,742 | B1 | | 7/2001 | Hanson et al. |

OTHER PUBLICATIONS

U.S. patent application Ser. No. 09/882,309, Hanson et al., filed Jun. 14, 2001.
Buehler Simplement 2000; FN00682 and FN00935; ©1990, 1995 Buehler Ltd,; 5 pgs (No month).

* cited by examiner

*Primary Examiner*—Donald R. Valentine
(74) *Attorney, Agent, or Firm*—Perkins Coie LLP

(57) ABSTRACT

A reactor assembly for electrochemically processing a microelectronic workpiece is set forth. The reactor assembly includes a processing bowl having one or more fluid inlets through which a flow of processing fluid is received. An electrode assembly is located within the process bowl in a fluid flow path of the fluid provided through the one or more fluid inlets. The electrode assembly includes a mesh electrode and a diffuser disposed in the fluid flow path prior to the mesh electrode to tailor the flow of processing fluid received from the one or more fluid inlets through the mesh electrode in a predetermined manner.

55 Claims, 5 Drawing Sheets

REACTOR FOR ELECTROCHEMICALLY PROCESSING A MICROELECTRONIC WORKPIECE INCLUDING IMPROVED ELECTRODE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention is directed to an apparatus for electrochemically processing a microelectronic workpiece. More particularly, the present invention is directed to a reactor assembly for electrochemically depositing, electrochemically removing and/or electrochemically altering the characteristics of a thin film material, like a metal or dielectric, at the surface of a microelectronic workpiece, such as a semiconductor wafer.

For purposes of the present application, a microelectronic workpiece is defined to include a workpiece formed from a substrate upon which microelectronic circuits or components, data storage elements or layers, and/or micromechanical elements are formed.

Production of semiconductor integrated circuits and other microelectronic devices from microelectronic workpieces, such as semiconductor wafers, typically requires the formation and/or electrochemical processing of one or more thin film layers on the workpiece. Electroplating and other electrochemical processes, such as electropolishing, electroetching, anodization, etc., have become important in the production of semiconductor integrated circuits and other microelectronic devices from such workpieces. For example, electroplating is often used in the formation of one or more metal layers on the workpiece. These metal layers are typically used to electrically interconnect the various devices of the integrated circuit. Further, the structures formed from the metal layers may constitute microelectronic devices such as read/write heads, etc. Such electrochemical processing techniques can be used in the deposition and/or alteration of blanket metal layers, blanket dielectric layers, patterned metal layers, and patterned dielectric layers.

The microelectronic manufacturing industry has applied a wide range of thin film layer materials to form such microelectronic structures. These thin film materials include metals and metal alloys such as, for example, nickel, tungsten, tantalum, solder, platinum, copper, copper-zinc, etc., as well as dielectric materials, such as metal oxides, semiconductor oxides, and perovskite materials.

Although the following discussion and subsequent embodiment of the present invention is described in the context of electroplating, it will be recognized that the teachings herein can be extended to other electrochemical processing techniques in which at least two electrodes are used. To this end, the electroplating of a microelectronic workpiece generally takes place in a reactor assembly. In such a reactor assembly, an anode electrode is disposed in a plating bath, and the workpiece with the seed layer thereon is used as a cathode. Only a lower face of the workpiece contacts the surface of the plating bath. The workpiece is held by a support system that may also include electrically conductive members that provide the requisite electroplating power (e.g., cathode current) to the workpiece.

Generally stated, electrochemical processing occurs as a result of an electrochemical reaction that takes place at the surface of the workpiece. In electroplating, for example, atoms of the material to be plated are deposited onto the workpiece, which functions as a cathode, by introducing an external electrical power source that supplies electrons to attract positively charged ions. The atoms are formed from ions present in the plating bath. In order to sustain the reaction, the ions in the plating bath must be replenished. Such replenishment may include the use of a consumable anode that releases the desired bath species as it is depleted from the bath.

When electroplating copper onto a workpiece, replenishment of the copper ions in the plating bath may be accomplished, at least in part, through the use of a consumable phosphorized copper anode. As copper ions are depleted from the plating bath, a corresponding number of copper ions are released by the anode into the plating bath. Other chemicals that are depleted during the electroplating process may be replenished by controlled dosing of the bath with one or more bath additives.

As the thin film layer is deposited onto the cathode, a related electrochemical oxidation reaction takes place at the anode. During this related electrochemical reaction, byproducts from the electrochemical reaction, such as particulates, precipitates, gas bubbles, etc., may be formed at the surface of the anode. Such byproducts may contaminate the processing bath and interfere with the formation of the thin-film layer at the surface of the workpiece. Furthermore, if these byproducts are allowed to remain in the plating bath at elevated levels near the anode, they may affect electrical current flow during the plating process and/or affect further reactions that take place at the anode. Still further, if the byproducts are allowed to migrate proximate the microelectronic workpiece, the byproducts could similarly interfere with the desired deposition of electroplated material thereby affecting the uniformity of the thickness of the deposited material.

Such byproducts can be particularly problematic in those instances in which the anode is consumable. For example, when copper is electroplated onto a workpiece using a consumable phosphorized copper anode, a black anode film is produced. The presence and consistency of the black film is important to ensure uniform anode erosion. This oxide/salt film is fragile, however. As such, it is possible to dislodge particulates from this black film into the electroplating solution. These particulates can then potentially be incorporated into the deposited film with undesired consequences.

A further consideration with respect to processes that use a consumable anode is erosion of the anode. Specifically, as the anode erodes, the distance between the anode and the cathode gradually increases. Furthermore, the overall shape of the anode as viewed by the workpiece changes. Such erosion, in turn, affects the strength and shape of the electric field formed between the anode and the cathode, thereby altering the deposition of material onto the surface of the microelectronic workpiece. Still further, consumable anodes erode to the point where they eventually need to be replaced.

Processes that do not make use of a consumable anode have also been developed. Generally, in these processes an inert anode is used in place of the consumable anode. Where the consumable anode, can provide a source for ions in the plating bath, an inert anode generally does not supply ions to the plating bath. In processes that use an inert anode, ions in the plating bath are generally replenished from the flow of fresh chemistry into the plating reactor. The plating solution containing fresh chemistry generally displaces the plating solution from which plating ions have been depleted. Consequently, the concentration of plating ions within the plating bath is largely affected by the flow of fresh plating solution within the plating reactor.

However the flow of plating solution is seldom uniform. The uniformity of the flow of fresh plating solution within the plating reactor can be affected by several different factors. One such factor includes the size, shape and position of the fluid inlet and the fluid outlet, which defines the starting point and the ending point for the fluid entering and or exiting the reactor. A further factor includes the size, shape and position of elements within the plating reactor, which may limit or obstruct fluid flow within the plating reactor, thereby altering the path of the fluid flow within the plating reactor. For example an object within the plating reactor may force fluid to be diverted around the object resulting in the fluid flow being more narrowly channeled around the outer periphery of the object. Additionally, this may result in the creation of dead spots within the chamber around which the fluid has been diverted and where the processing fluid remains relatively stagnant. This can result in localized areas where replenishment of the processing fluid and the corresponding concentration of fresh plating ions is affected thereby resulting in non-uniformity of the deposited film.

One factor that can affect the rate at which a material is electroplated onto a workpiece is the concentration of the ion species proximate the surface of the workpiece. As ions are consumed or plated out of the plating solution proximate a particular location on the surface of the workpiece, the ions need to be replaced or replenished to insure ions are available for continued plating of the material onto the surface of the workpiece. To the extent that the ions necessary for further plating are not replenished, the rate of reaction at the surface of the microelectronic workpiece will suffer. Local differences in the rate of plating can result in undesirable non-uniformity of the overall plated layer.

Still further, a related electrochemical oxidation reaction takes place proximate the inert anode. This related reaction similarly requires that certain ions be present and continuously replenished for the related reaction to continue at the anode in the desirable manner. For example, in the absence of a suitable reducing agent proximate the anode, water in the plating bath may be oxidized resulting in gas bubbles at the anode. This may contaminate the processing bath and interfere with the formation of the thin film layer at the surface of the microelectronic workpiece. Additionally, the related reaction at the anode may be impacted by local concentrations of ions in the plating solution and the corresponding fluid flow proximate portions of the anode.

The present inventors have recognized the foregoing problems and have developed a reactor for electrochemically processing a microelectronic workpiece that manages the flow of electrochemical processing solution within the reactor so as to provide for a generally uniform flow of processing solution throughout. Flow of the electrochemical processing solution is controlled proximate the workpiece as well as proximate the anode. Such control provides for a more even distribution in the concentration of reactants required for the electrochemical processing reactions at the anode and the cathode. In this way, uniform electrochemical processing, such as the electrolytic deposition of material onto a microelectronic workpiece, can be achieved.

BRIEF SUMMARY OF THE INVENTION

A reactor assembly for electrochemically processing a microelectronic workpiece is set forth. The reactor assembly includes a processing bowl having one or more fluid inlets through which a flow of processing fluid is received. An electrode assembly is located within the process bowl in a fluid flow path of the fluid provided through the one or more fluid inlets. The electrode assembly includes a mesh electrode and a diffuser disposed in the fluid flow path prior to the mesh electrode to tailor the flow of processing fluid received from the one or more fluid inlets through the mesh electrode in a predetermined manner.

In accordance with one embodiment of the invention, the diffuser is formed as a separate component from the mesh electrode. The diffuser is disposed between the one or more fluid inlets and the mesh electrode to tailor the flow of processing fluid traveling between the one or more fluid inlets and the mesh electrode. In accordance with another embodiment the diffuser is integral with the mesh electrode. The reactor may also include an electrode support assembly that is dimensioned to direct substantially all of the processing fluid received through the one or more fluid inlets toward the mesh electrode.

A further diffuser may also be employed between a portion of the fluid flow path between the mesh electrode and the microelectronic workpiece. Optionally, the further diffuser may be constructed so that the flow therethrough optimizes the conditions under which the fluid contact the mesh electrode. This assists in ensuring that the fluid and mesh anode are in contact with one another under conditions that allow the completion of any reactions between them before the fluid is provided for contact with contact the microelectronic workpiece being processed. Alternatively, or in addition, a pump that is used to supply the fluid to the reactor chamber may control such flow.

Various constructions of the mesh electrode are also set forth. Further, an integrated tool including a reactor constructed in accordance with one embodiment of the present invention is set forth.

DETAILED DESCRIPTION OF THE INVENTION

Figure 1:
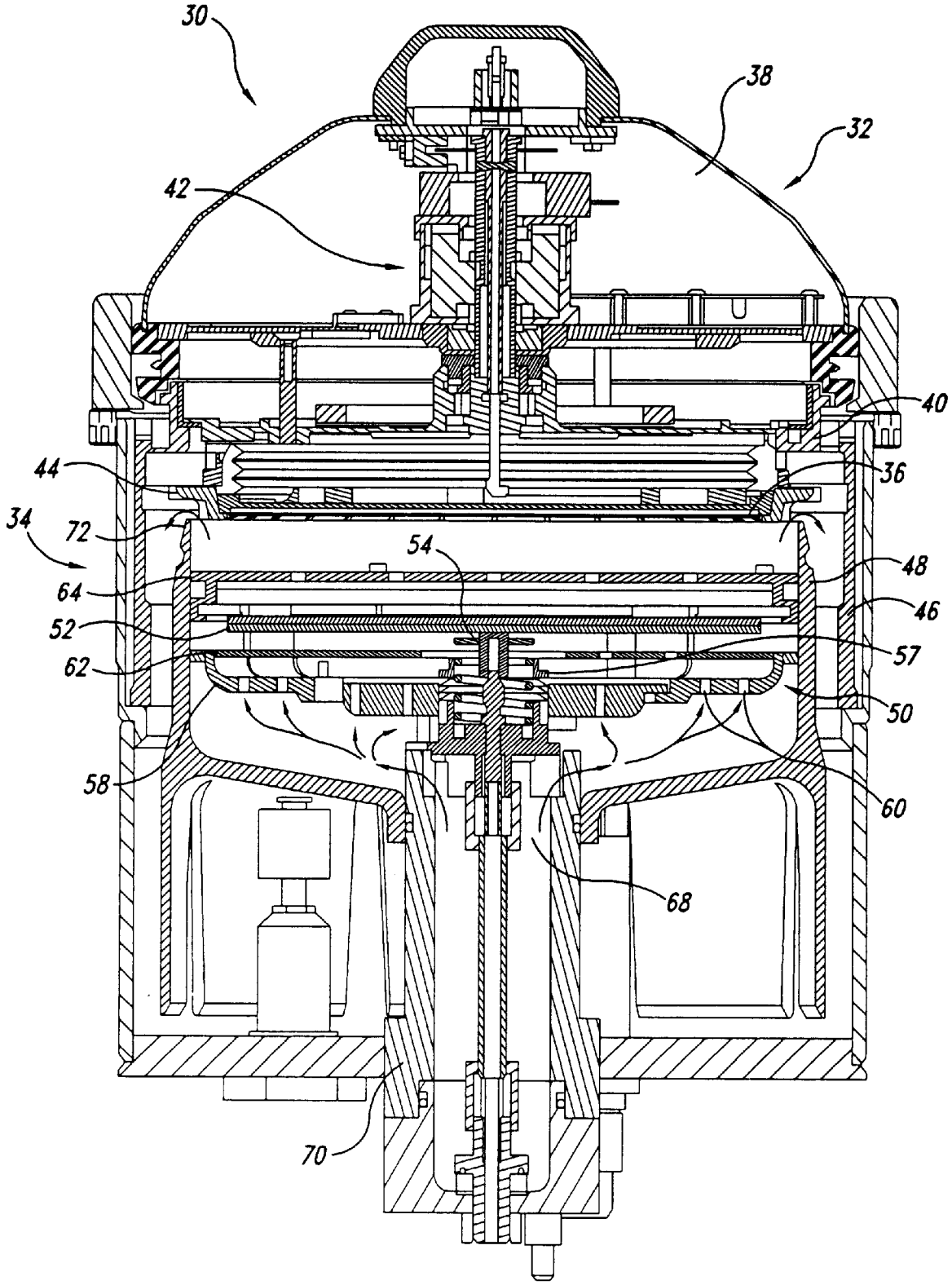
FIG. 1 is a cross-sectional side view of a reactor assembly constructed in accordance with one embodiment of the present invention.

FIG. 1 is a cross-sectional side view of a reactor assembly 30 for electrochemically processing a microelectronic workpiece in accordance with one embodiment of the present invention. In the particular embodiment of the invention shown here, the reactor 30 is adapted for electrochemical deposition of a metal, such as copper or a copper alloy, onto the surface of the microelectronic workpiece. Accordingly, the following description includes express references to elements used in such electrochemical deposition processes. It will be recognized, however, that the architecture of the reactor 30 is suitable for a wide range of electrochemical processing operations including, for example, anodization, electro-etch, electropolishing, etc. of a surface of the workpiece.

The reactor 30 has a head assembly 32 that assists in supporting the workpiece during processing, and a corresponding processing space in the form of a bowl assembly 34. The bowl assembly 34 includes one or more walls that define a processing space that receives a processing fluid, as will be set forth in further detail below. This type of reactor 30 is particularly suited for effecting electroplating of semiconductor wafers or like workpieces, in which the workpiece is electroplated with a blanket or patterned metallic layer.

The head assembly 32 and the bowl assembly 34 of the illustrated embodiment may be moved relative to one another. For example, a lift and rotate mechanism, not shown, may be used in conjunction with the head assembly 32 and the bowl assembly 34 to drive the head assembly 32 in a vertical direction with respect to the bowl assembly 34 and to rotate the head assembly 32 about a horizontally disposed axis. By lifting and rotating the head assembly 32, a workpiece 36, such as a semiconductor wafer, may be moved between a load position that allows the workpiece 36 to be placed upon the head assembly 32, and a processing position in which at least a portion of the workpiece 36 is brought into contact with processing fluid in the processing space of the bowl assembly 34. When the workpiece 36 is in the processing position, it is generally oriented with the process side down within the processing space. When the workpiece 36 is in the load position, the workpiece 36 is generally exposed outside of the bowl assembly 34 with the process side directed upward, for loading and unloading by, for example, a workpiece transport unit 18. One example of a suitable lift and rotate mechanism is described in connection with U.S. patent application Ser. No. 09/351,980, filed Jul. 12, 1999, entitled "Lift and Rotate Mechanism for Use in a Workpiece Processing Apparatus", now U.S. Pat. No. 6,168,695, the disclosure of which is incorporated herein by reference.

The head assembly 32 may include a stationary section 38 and a rotational section 40. The rotational section 40 is coupled to the stationary section 38 via a motor 42. The rotational section 40 is configured with one or more structures that serve to support the workpiece and to rotate the workpiece 36 about a generally vertical axis during, for example, workpiece processing.

In the reactor assembly embodiment 30 of FIG. 1, the workpiece 36 is held in place, with respect to the rotational section 40 by contact assembly 44. In addition to holding the workpiece 36 in place, the contact assembly 44 may include one or more electrical contacts that are disposed to engage the workpiece 36 for applying electrical power used in the electrochemical processing operation. One embodiment of a contact assembly is described in detail in connection with U.S. patent application Ser. No. 09/386,803, filed Aug. 31, 1999, entitled "Method and Apparatus for Processing the Surface of a Microelectronic Workpiece", now U.S. Pat. No. 6,309,520, the disclosure of which is incorporated herein by reference. It will be recognized, however, that other contact architectures, such as discrete finger contacts or the like, are also suitable depending on the desired electrochemical processing that is to take place in the reactor 30. An alternative contact configuration including a J-hook design is described in connection with U.S. patent application Ser. No. 08/680,057, filed Jul. 15, 1996, and entitled "Electrode Semiconductor Workpiece Holder", now U.S. Pat. No. 5,980,706, the disclosure of which is similarly incorporated herein by reference.

During processing, the workpiece 36 is brought into contact with processing fluid located within the bowl assembly 34. In the illustrated embodiment, bowl assembly 34 comprises a processing base 46 that, in turn, includes processing bowl 48. The processing bowl 48 has an outer wall, which defines a processing space into which a flow of the processing fluid is provided. An electrode assembly 50 constructed in accordance with one embodiment of the present invention is disposed within the processing bowl 48. The electrode assembly 50 includes an electrode 52 that is in electrical contact with the processing fluid located within the processing space. Electrode 52, as will be set forth in further detail below, is used in the electrochemical processing of workpiece 36.

Electrode 52 is constructed to allow processing fluid to pass through it. For example, electrode 52 may be formed from a conductive material that has been woven into a mesh structure having a predetermined fluid flow permeability suitable for the particular process and the desired control of the flow of electrochemical processing solution. In the illustrated embodiment, the electrode 52 is formed from one or more layers of wire mesh material that allow the processing fluid to flow through the interstitial regions formed between the woven material. Although other materials may be used to form the electrode 52, the wire mesh material may be formed from an inert material, such as platinized titanium. Other examples of suitable materials for forming the electrode 52 include iridium oxide, ruthenium, palladium, ceramic, and metal oxide. By using a wire mesh, the flow of processing fluid can proceed past the electrode 52 with minimal disruption to the uniformity of the fluid flow. The electrode 52 may also be formed, at least in part, from a consumable material.

In addition to providing minimal disruption of the uniformity of the fluid flow as the processing fluid proceeds past the electrode 52, by flowing through the electrode 52 as opposed to around the electrode 52, stagnant fluid flow areas in the processing bowl 48 proximate the surface of the electrode 52 are generally avoided. In this way fresh chemistry including replenishing levels of reactive ions is adequately supplied proximate the electrode 52.

Figure 2:
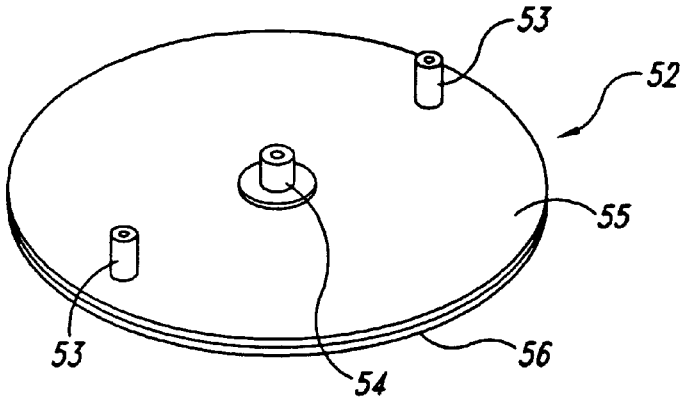
FIG. 2 is an isometric view of one example of an electrode for use in the reactor assembly illustrated in FIG. 1 viewed from the bottom.

FIG. 2 is a bottom isometric view of one embodiment of an electrode 52 and appertaining structures that may be used in reactor 30 illustrated in FIG. 1. As shown, a connector 54 may be provided at the base of electrode 52 for supplying electrical power to the electrode. The specific function of the electrode during electrochemical processing is, of course, dependent upon the specific type of electrochemical processing that is being executed. For example, in electroplating a metal or a metal alloy onto the surface of the microelectronic workpiece, the electrode 52 is connected to an external electrical power supply so that it functions as an anode. In other electrochemical processes, such as anodization, de-plating, etc., the electrode 52 is connected to function as a cathode.

A pair of standoffs 53 may be provided for connecting the electrode 52 to other elements of the electrode assembly 50. This is discussed below in greater detail in connection with FIGS. 7–9.

Figure 3:
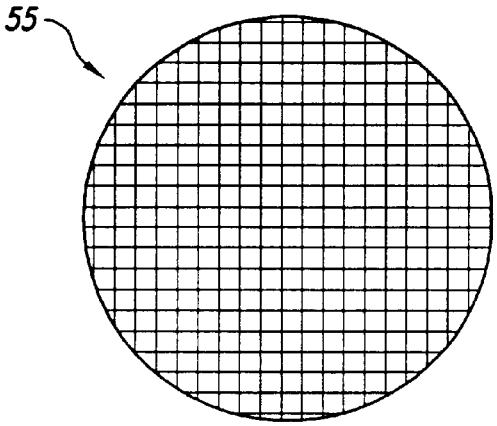
FIG. 3 is a partial plan view showing one manner in which a first layer of wire mesh forming the electrode illustrated in FIG. 2 may be oriented.
Figure 4:
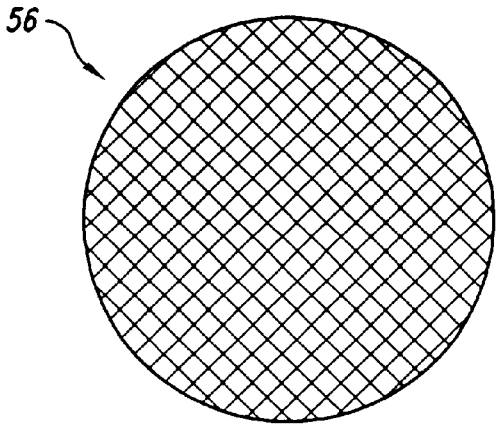
FIG. 4 is a partial plan view showing one manner in which a second layer of wire mesh forming the electrode illustrated in FIG. 2 may be oriented.
Figure 5:
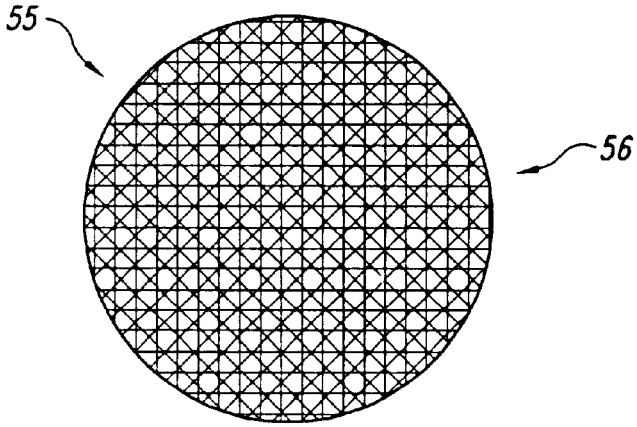
FIG. 5 is a partial plan view of the electrode illustrated in FIG. 2 showing one manner in which the first layer of wire mesh material illustrated in FIG. 3 may be combined with the second layer of wire mesh material illustrated in FIG. 4.

As noted above, electrode 52 may be formed from multiple layers of overlaid wire mesh material. Such a construction is illustrated in FIGS. 3–5. In this construction, the layers may be rotated with respect to one another, so as to retain the overall porous nature of the electrode 52, while concurrently reducing the size of the openings in the electrode 52 through which the processing fluid flows. FIGS. 3 and 4 are partial plan views of single material layers that may be joined to form such a multiple layer electrode configuration. In the illustrated embodiment, a dual layer structure is employed. The dual layer structure includes a first layer 55 and a second layer 56, each formed from a wire mesh having the exemplary angular orientation of wire material shown in FIGS. 3 and 4, respectively. FIG. 5 is a partial plan view of electrode 52 showing the first wire mesh layer 55 overlying the second wire mesh layer 56 to form the composite electrode 52.

In the illustrated embodiment, connector 54 may be soldered to electrode 52, proximate the center of electrode 52. With reference to FIG. 1, the connector 54 may be of the type that mates with a corresponding connector 57, such as a banana plug or the like, located proximate the center of the base of the processing bowl 48. Such a connector configuration facilitates simple connector alignment, thereby making it an easy task to connect and remove the electrode assembly 50 to and from the processing bowl 48.

This connector configuration, however, may result in an obstruction to fluid flow through the center of electrode 52 and affect processing of the workpiece at one or more sites corresponding to the obstructive fluid flow path. Even if the microelectronic workpiece 36 is rotated during processing, the same portion of the microelectronic workpiece 36 will generally remain above the obstructive fluid flow path when the axis of rotation for the microelectronic workpiece 36 coincides with the position of the mating connectors.

Alternatively, the position of the mating connectors may be laterally offset from center. With such an offset connector configuration, however, greater care must generally be used in aligning the mating connectors 54, 57. This laterally offset configuration may be used to position the fluid flow path obstruction beneath a non-central portion of the microelectronic workpiece 36 corresponding to the lateral offset of the position of the mating connectors. By using such an offset position, the time any given portion of the microelectronic workpiece 36 is disposed along the obstructive fluid flow path is generally limited. Nevertheless, asymmetrical processing will occur radially across the surface of the workpiece due to the obstructive fluid flow path.

Figure 6:
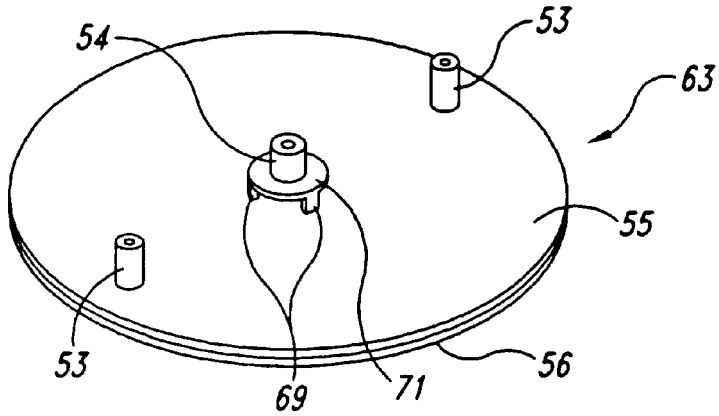
FIG. 6 is an isometric view of a further example of an electrode for use in the reactor assembly illustrated in FIG. 1 viewed from the bottom.

As a further alternative, the position of the mating connector could remain aligned with the center of the electrode 52, but be vertically offset. An example of an embodiment incorporating this further alternative is illustrated in FIG. 6. In FIG. 6, a connector 54 is illustrated soldered to electrode 63. In the illustrated embodiment, connector 54 is soldered to electrode 63 via three legs 69, which extend from the base 71 of the connector 54. In addition to elevating the bulk of the connector away from the surface of the electrode 63, the legs 69 also laterally offset the three points of electrical contact away from the center of the electrode 63. This enables the points of electrical contact to be aligned below different portions of the workpiece 36 as the workpiece 36 is rotated with respect to the electrode 63. Otherwise the electrode 63 is similar to the electrode 52 illustrated in FIG. 2.

In addition to the fluid flow management properties of the porous electrode 52, other portions of the electrode housing assembly 50 also contribute to the overall fluid flow management. Such portions include an electrode support assembly 58 having a plurality of openings 60 through which processing fluid can flow. The support assembly 58 has an outer circumference that may extend to and engage the inner wall of the processing bowl 48. By extending the outer circumference of the support assembly 58 to the inner wall of the processing bowl 48, the processing fluid is substantially prevented from flowing around the outer circumference of the support assembly 58. As a result, the flow of processing fluid is principally limited to the plurality of openings 60. The plurality of openings 60 of the support assembly 58 may be positioned to evenly distribute the flow of processing fluid or to otherwise tailor the fluid flow in a manner that is optimized for the particular process that is implemented. In the absence of the support assembly 58, the fluid would tend to travel upward along the outer wall of the processing bowl 48. By incorporating the support assembly 58, the flow of processing fluid is at least partially diverted back towards the center of the processing bowl 48 so that it may flow in the desired manner through the electrode 52.

The electrode housing assembly 50 may also include a pair of diffusers, a lower diffuser 62 and an upper diffuser 64, that contribute to the fluid flow management. Similar to support assembly 58, each of the diffusers 62 and 64 includes a corresponding plurality of openings through which the processing fluid is diverted. The fluid travels through the respective diffuser 62, 64 via the plurality of openings. The size, shape and location of the plurality of openings through each of the diffusers 62, 64 help define the resulting fluid distribution. In order to more precisely control and/or manually adjust the flow of fluid through each of the diffusers, the individual openings can be manually covered and/or uncovered by using, for example, plugs in the individual openings.

The lower diffuser 62 of the illustrated embodiment is oriented in a plane substantially parallel to the electrode 52, and is located between the electrode 52 and the support assembly 58. Since lower diffuser 62 is positioned before the electrode 52 in the fluid flow path, the flow of the processing fluid prior to contacting the electrode 52 is modified. Specifically, the lower diffuser 62 may be designed to substantially distribute the flow of fluid evenly across the entire surface of the electrode 52. As the fluid flows through the electrode 52 in this manner, fluid containing fresh chemistry replaces the fluid previously proximate the electrode 52. In this way fresh reactants can be continuously supplied across substantially the entire surface of the electrode 52, thereby inhibiting the formation of fluid stagnation areas that may adversely impact the overall electrochemical process. In addition to the openings through which the processing fluid flows, the lower diffuser 62 and the support assembly 58 may also include one or more openings through which the electrical connection is made to the electrode 52. In some instances, lower diffuser 62 may be used without a support assembly 58. In such instances, it may be desirable to extend the circumference of lower diffuser 62 to the inner walls of the processing bowl so that substantially all of the fluid proceeding from fluid inlet 68 is directed through the openings of diffuser 62. Alternatively, in other instances, a support assembly 58 may be used without a lower diffuser 62.

The upper diffuser 64 of the illustrated embodiment is also oriented in a plane substantially parallel to the electrode 52. However as opposed to being located between the electrode 52 and the support assembly 58, the upper diffuser 64 is located between the electrode 52 and the microelectronic workpiece 36 (or between the electrode 52 and other electrical/fluid flow management devices). This allows the flow of processing fluid to be principally constrained to a flow region tailored to the specific shape of microelectronic workpiece 36 or to otherwise meet processing parameters defined by the processing recipe. This fluid flow management configuration thus allows the fluid flow through electrode 52 to be optimized by lower diffuser 62 in accordance with one set of predetermined fluid flow characteristics while concurrently allowing the electrochemical processing fluid flow to, for example, the microelectronic workpiece 36 is provided in accordance with a further set of predetermined fluid flow characteristics. For example, it may be desirable to localize the flow of processing fluid to the area of the electrode 52 using lower diffuser 62 and to provide a more diffuse flow of processing fluid to the surface of the microelectronic workpiece 36 using upper diffuser 64. As a result of the tailored fluid flows, the electrochemical reactions at the electrode 52 and at the surface of the microelectronic workpiece 36 may be optimized to provide substantially uniform electrochemical processing of the workpiece.

In an alternative embodiment, the upper diffuser 64 may be constructed to cooperate with the design of the lower diffuser 62 (or, alternatively, be self-sufficient) to optimize the time duration over which the fluid and mesh electrode are in contact with one another. As will be recognized, such optimization can be achieved through the particular placement of the openings in each of the diffusers and/or using the relative overall flow areas defined by the openings of the diffusers as a diffuser design constraint. This may, if desired, be used to assist in ensuring that the fluid and mesh anode are in contact with one another under conditions that allow the completion of any reactions between them before the fluid is allowed to contact and react with the microelectronic workpiece.

In some instances it may be possible to incorporate the functionality of one or both of the diffusers 62, 64 into the structure of the electrode 52. To this end, the mesh electrode 52 have a multilayer structure in which the openings defined by a mesh structure at the upper and lower surfaces of the electrode provide the tailored fluid flow. Furthermore, such effects can be localized with respect to certain portions of the electrode 52 or can be made more uniform across the entire surface of the electrode 52 by adjusting the specific construction of the electrode 52. In these instances, the use of both an upper diffuser 64 and a lower diffuser 62, as well as the fluid distribution capabilities of the support assembly 58 may not be needed, but may be optionally included in the overall assembly.

Figure 7:
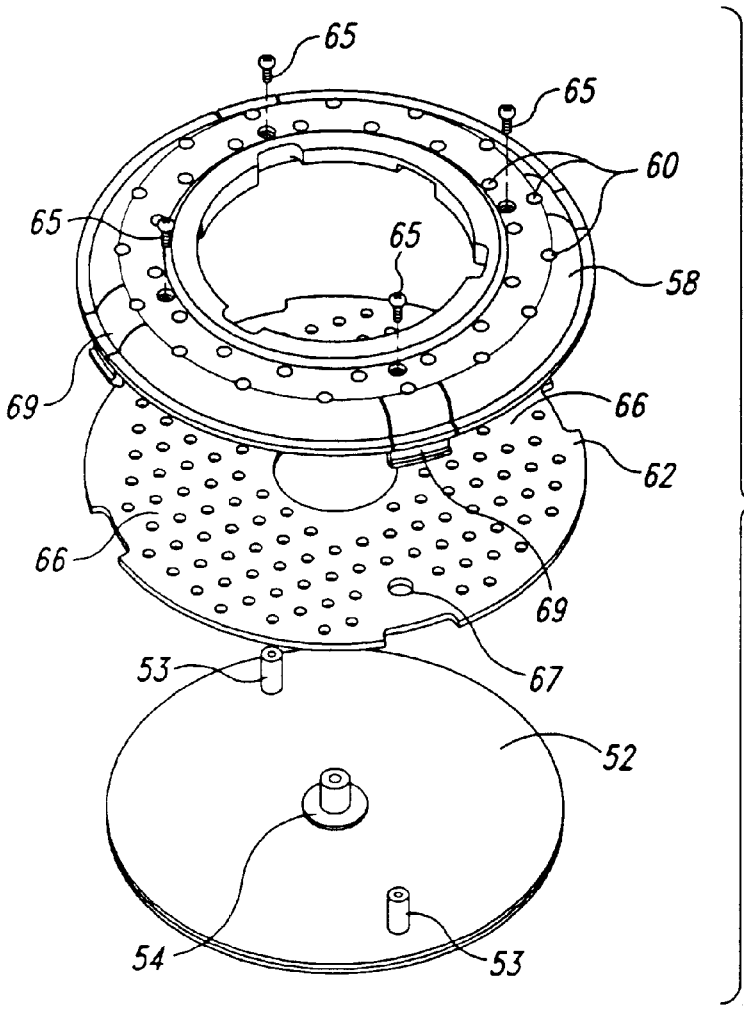
FIG. 7 is an exploded isometric view showing a portion of the electrode assembly illustrated in FIG. 1 as viewed from the bottom.
Figure 8:
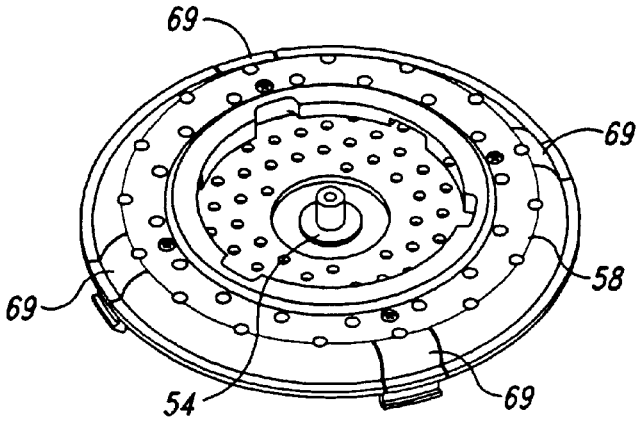
FIG. 8 is an isometric view of the portion of the electrode assembly illustrated in FIG. 7.
Figure 9:
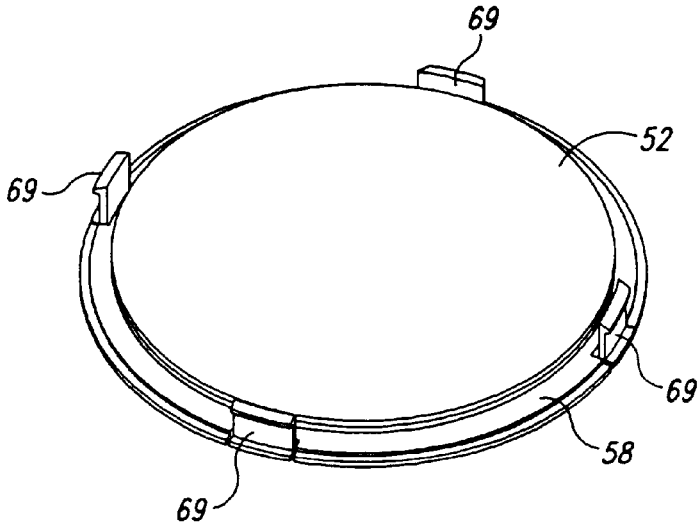
FIG. 9 is a top isometric view of the portion of the electrode assembly illustrated in FIG. 8.

FIG. 7 is an exploded isometric view showing the support assembly 58, the lower diffuser 62 and the electrode 52 of the electrode assembly 50. The support assembly 58, the lower diffuser 62 and the electrode 52, in the illustrated embodiment may be at least partially held together by threaded fasteners 65 or the like. A first pair of threaded fasteners 65 connects the support assembly 58 to the lower diffuser 62 through corresponding threaded holes 66 in the lower diffuser 62. A second pair of threaded fasteners connects the support assembly 58 to standoffs 53 of the electrode 52 through a pair of aligned openings 67 in the lower diffuser 62. The support assembly 58 further includes four clips 69 located around the outer circumference of the support assembly 58 to facilitate insertion of the electrode assembly 50 into the processing bowl 48. FIGS. 8 and 9 are top and bottom isometric view of the assembled electrode assembly 50.

Figure 10:
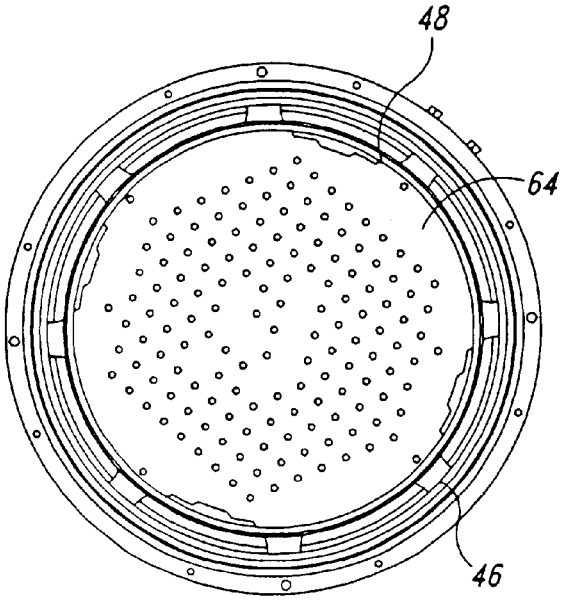
FIG. 10 is a top plan view of the embodiment of the reactor shown in FIG. 1 in which the head assembly has been removed.

FIG. 10 it is a top plan view of the reactor 30 with the head assembly 32 removed. In connection therewith, FIG. 10 further illustrates one potential hole pattern of the top diffuser 64 that may be used to tailor the fluid flow to the microelectronic workpiece.

With reference again to FIG. 1, a fluid inlet 68 is disposed at the bottom of the processing bowl 48 and includes one or more openings that are in fluid communication with a riser tube 70, through which processing fluid is received. The processing fluid is generally received from a fluid reservoir located external to the reactor 30.

The processing fluid is directed.through the riser tube 70 into the processing bowl 48 via the fluid inlet 68. The processing fluid then enters the electrode assembly 50 via the plurality of openings 60 in the support assembly 58. As the fluid passes through the support assembly 58 via the plurality of openings 60, the distribution of the flow of processing fluid is tailored so that it is at least partially diverted toward the center of the processing bowl 48 away from the outer wall. After passing through the openings 60 of the support assembly 58 the fluid flows through the lower diffusor 62, where the fluid flow is tailored, at least in the illustrated embodiment, to maximize fluid flow through and fluid contact with the conductive portions of electrode 52.

Once the processing fluid has passed through the electrode 52, it encounters the upper diffuser 64. As fluid flows through this upper diffuser, the flow is again tailored so that it may be evenly distributed across the surface of the microelectronic workpiece 36, or has such other characteristics desirable for the particular processing recipe that is being implemented. Further, as noted above, the upper diffuser 64 may be constructed to cooperate with the design of the lower diffuser 62 to optimize the conditions under which the fluid and mesh electrode are in contact with one another, This assists in ensuring that the fluid and mesh anode are in contact with one another under conditions that allow the completion of any reactions between them before the fluid is allowed to contact and react with the microelectronic workpiece. After contacting the microelectronic workpiece 36, the fluid exits from the processing cup over an overflow weir 72, shown here as the upper lip of the processing bowl 48. Arrows illustrate examples of partial fluid flows as the processing fluid progresses through the processing bowl 48.

It will be recognized that the foregoing reactor 30 may be employed in any number of microelectronic fabrication environments requiring the electrochemical processing of one or more microelectronic workpieces. For example, as illustrated in FIGS. 11 and 12, the reactor 30 may be disposed in an integrated processing tool 100 or the like.

Figure 11:
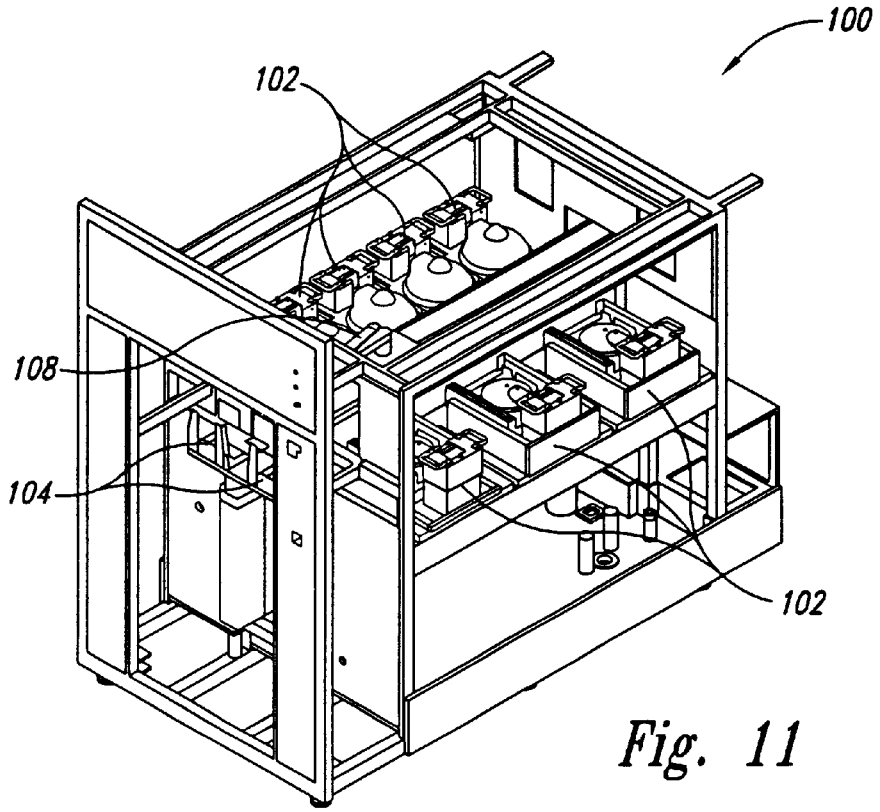
FIG. 11 is an isometric view of an integrated processing tool in accordance with one embodiment of the present invention in which the processing tool is shown with several panels removed.
Figure 12:
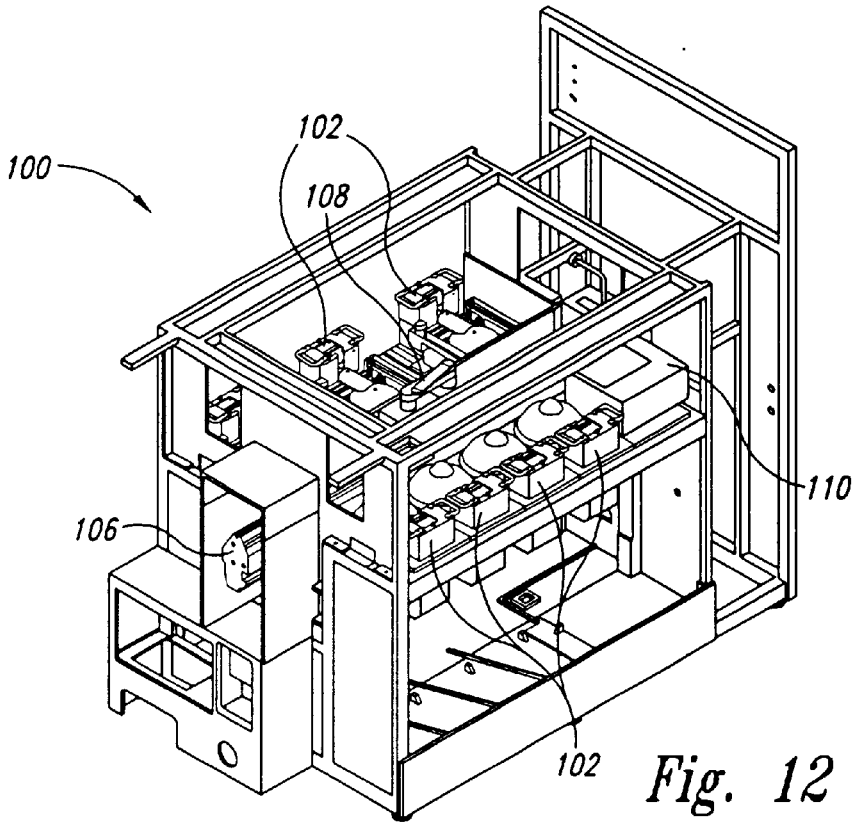
FIG. 12 is a further isometric view of the integrated processing tool shown in FIG. 11.

FIGS. 11 and 12 illustrate corresponding isometric views of one example of such an integrated processing tool 100. The integrated processing tool 100 is shown with several panels removed. The integrated processing tool 100 incorporates multiple processing stations 102 of the same and/or varying types. Workpieces are generally received within the integrated processing tool 100, via one or more cassettes containing one or more workpieces. The cassettes containing the workpieces enter and exit the integrated processing tool 100, via a door in the side of the integrated processing tool 100, where the cassettes are received by a pair of lift/tilt mechanisms 104. The lift/tilt mechanisms 104 position and orient the cassettes to provide access to the individual workpieces contained therein. A linear conveyor system 106 receives the individual workpieces and relays them to the various processing stations 102.

Additional details in connection with at least one example of a lift/tilt mechanism 104 and a linear conveyor system 106 are provided in connection with U.S. patent application Ser. No. 08/990,107, entitled "Semiconductor Processing Apparatus having Linear Conveyor System", the disclosure of which is incorporated herein by reference.

In accordance with one embodiment, the linear conveyor system 106 includes two workpiece transport units 108 or robot arms, which move independently with respect to one another. One of the workpiece transport units 108 generally handles dry workpieces, while the other workpiece transport unit 108 generally handles wet workpieces.

The illustrated integrated processing tool 100 may also include a pre-aligner 110, which establishes the alignment of the workpiece within the integrated processing tool 100 by referencing a known registration notch on each of the workpieces. Prior to forwarding the workpiece to any of the other processing stations 102, the workpiece may be placed within the pre-aligner 110 to locate the registration notch. After the pre-aligner 110 locates the registration notch, the pre-aligner 110 then makes any necessary adjustments to the orientation and alignment of the workpiece for facilitating proper subsequent handling. The integrated processing tool 100 can incorporate any one of several known pre-aligners commonly available. An example of one such suitable pre-aligner for use in the integrated processing tool 100, as presently configured, includes a pre-aligner manufactured and sold by PRI Automation, Equipe Division, under the model number PRE-201-CE.

The integrated processing tool 100 can further include various combinations and arrangements of individual processing stations 102. In addition to reactor 30 described above in connection with FIGS. 1–10, other examples of the various types of processing stations 102 for use in the integrated processing tool 100 could include SRD modules (Spin, Rinse, Dry), pre-plate modules, magnetic reactor processing stations, and/or non-magnetic reactor processing stations.

By integrating reactor 30 into an integrated processing tool 100 including additional processing stations 102, several processing steps can be performed with respect to a workpiece while correspondingly reducing the amount of intervening handling required by an operator.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. A reactor for processing a microelectronic workpiece comprising:

a processing bowl having one or more fluid inlets through which a flow of processing fluid is received; and an electrode assembly located within the process bowl in a fluid flow path that extends from the one or more fluid inlets toward a workpiece support, the electrode assembly comprising a mesh electrode through which processing fluid may flow, and a diffuser disposed in the fluid flow path prior to the mesh electrode to tailor the flow of processing fluid received from the one or more fluid inlets through the mesh electrode in a predetermined manner.

2. A reactor in accordance with claim 1 and further comprising a further diffuser disposed between the mesh electrode and the workpiece to tailor the flow of the processing fluid traveling between the mesh electrode and the workpiece.

3. A reactor in accordance with claim 1 and further comprising a support assembly that is dimensioned to direct substantially all of the processing fluid received through the fluid inlet to flow through the diffuser toward the mesh electrode.

4. A reactor in accordance with claim 1 wherein the reactor further comprises a head assembly adapted to receive a microelectronic workpiece and to conduct electrical power to the microelectronic workpiece.

5. A reactor in accordance with claim 4 wherein the head assembly is movable from a workpiece loading position to a workpiece processing position in which the workpiece is in contact with the flow of processing fluid.

6. A reactor in accordance with claim 4 wherein the head assembly includes a rotor and a rotor drive connected to rotate the microelectronic workpiece with respect to the bowl assembly during electrochemical processing.

7. A reactor in accordance with claim 1 wherein the electrode assembly further comprises a support assembly having an outer circumference which extends proximate to an internal surface of the processing bowl to thereby direct a substantial portion of the fluid proceeding from the one or more fluid inlets toward the mesh electrode.

8. A reactor in accordance with claim 1 wherein the mesh electrode comprises a plurality of mesh layers.

9. A reactor in accordance with claim 8 wherein the plurality of mesh layers are offset from one another to define interstitial regions through which the processing fluid may flow.

10. A reactor in accordance with claim 1 wherein the electrode assembly further comprises a connector coupled to the mesh electrode through which processing power is supplied to the mesh electrode.

11. A reactor in accordance with claim 10 wherein the connector is soldered to the mesh electrode.

12. A reactor in accordance with claim 10 wherein the connector is centered with respect to the mesh electrode.

13. A reactor in accordance with claim 10 wherein the connector is offset from the center of the mesh electrode.

14. A reactor in accordance with claim 10 wherein the connector is coupled to the mesh electrode by a standoff.

15. A reactor in accordance with claim 14 wherein the standoff includes a base connected to the mesh electrode via a plurality of legs.

16. A reactor in accordance with claim 1 wherein the mesh electrode comprises an inert material.

17. A reactor in accordance with claim 16 wherein the mesh electrode comprises platinized titanium.

18. A microelectronic workpiece processing apparatus comprising:

an input/output section adapted for loading and unloading groups of microelectronic workpieces;

a processing section having one or more processing stations for processing the microelectronic workpieces, at least one of the processing stations comprising a reactor assembly including a processing bowl having one or more fluid inlets through which a flow of processing fluid is received, an electrode assembly located within the process bowl in a fluid flow path of the fluid received through the one or more fluid inlets, the electrode assembly including a mesh electrode through which processing fluid may flow, and a diffuser disposed in the fluid flow path prior to the mesh electrode to tailor the flow of processing fluid received from the one or more fluid inlets through the mesh electrode in a predetermined manner, and a microelectronic workpiece transfer apparatus disposed to convey the microelectronic workpieces between at least the input/output section and the one or more processing stations.

19. A microelectronic workpiece processing apparatus in accordance with claim 18 and further comprising a further diffuser disposed between the mesh electrode and the workpiece to tailor the flow path of the processing fluid traveling between the mesh electrode and the workpiece.

20. A microelectronic workpiece processing apparatus in accordance with claim 18 wherein the electrode assembly further comprises a support assembly that is dimensioned to direct substantially all of the processing fluid received through the one or more fluid inlets to flow through the diffuser.

21. A microelectronic workpiece processing apparatus in accordance with claim 18 wherein the reactor assembly includes a head assembly adapted for receiving a microelectronic workpiece and conducting electrical power to the microelectronic workpiece.

22. A microelectronic workpiece processing apparatus in accordance with claim 21 wherein the head assembly is movable to bring the workpiece into contact with the flow of processing fluid in the process bowl.

23. A microelectronic workpiece processing apparatus in accordance with claim 21 wherein the head assembly includes a rotor and a rotor drive connected to rotate the microelectronic workpiece with respect to the processing bowl during electrochemical processing.

24. A microelectronic workpiece processing apparatus in accordance with claim 21 wherein the mesh electrode comprises a plurality of mesh layers.

25. A microelectronic workpiece processing apparatus in accordance with claim 24 wherein the plurality of mesh layers are offset from one another to define interstitial regions through which the processing fluid may flow.

26. A microelectronic workpiece processing apparatus accordance with claim 18 wherein the electrode assembly comprises a support assembly having an outer circumference which extends proximate to an internal surface of the processing bowl.

27. A microelectronic workpiece processing apparatus in accordance with claim 18 wherein the electrode assembly further comprises a connector coupled to the mesh electrode through which processing power is supplied to the mesh electrode.

28. A microelectronic workpiece processing apparatus in accordance with claim 27 wherein the connector is soldered to the mesh electrode.

29. A microelectronic workpiece processing apparatus in accordance with claim 27 wherein the connector is centered with respect to the mesh electrode.

30. A microelectronic workpiece processing apparatus in accordance with claim 27 wherein the connector is offset from the center of the mesh electrode.

31. A microelectronic workpiece processing apparatus in accordance with claim 27 wherein the connector is coupled to the mesh electrode by a standoff.

32. A microelectronic workpiece processing apparatus in accordance with claim 31 wherein the standoff includes a base connected to the mesh electrode via a plurality of legs.

33. A microelectronic workpiece processing apparatus in accordance with claim 18 wherein the mesh electrode comprises an inert material.

34. A microelectronic workpiece processing apparatus in accordance with claim 18 wherein the mesh electrode comprises platinized titanium.

35. An electrode assembly for use in processing a microelectronic workpiece comprising:

a mesh electrode through which processing fluid may flow; and a diffuser disposed proximate to the mesh electrode to tailor the flow of processing fluid flowing to the mesh electrode.

36. An electrode assembly in accordance with claim 35 and further comprising an additional diffuser located proximate the mesh electrode so as to tailor the flow of processing fluid flowing from the mesh electrode.

37. An electrode assembly in accordance with claim 35 and further comprising a support assembly coupled to the mesh electrode, wherein the support assembly is dimensioned to direct substantially all of the processing fluid toward the mesh electrode and thereby limiting the amount of processing fluid flowing around the mesh electrode toward a microelectronic workpiece being processed.

38. An electrode assembly in accordance with claim 37 wherein the plurality of mesh layers are offset from one another to define interstitial regions through which the processing fluid may flow.

39. An electrode assembly in accordance with claim 38 wherein the connector is centered with respect to the mesh electrode.

40. An electrode assembly in accordance with claim 35 wherein the mesh electrode comprises a plurality of mesh layers.

41. An electrode assembly in accordance with claim 35 wherein the electrode assembly further comprises a connector coupled to the mesh electrode through which processing power is supplied to the mesh electrode.

42. An electrode assembly in accordance with claim 41 wherein the connector is soldered to the mesh electrode.

43. An electrode assembly in accordance with claim 41 wherein the connector is offset from the center of the mesh electrode.

44. An electrode assembly in accordance with claim 41 wherein the connector is coupled to the mesh electrode by a standoff.

45. An electrode assembly in accordance with claim 44 wherein the standoff includes a base connected to the mesh electrode via a plurality of legs.

46. An electrode assembly in accordance with claim 35 wherein the mesh electrode comprises an inert material.

47. An electrode assembly in accordance with claim 46 wherein the mesh electrode comprises platinized titanium.

48. A reactor for processing a microelectronic workpiece comprising:

a processing bowl having one or more fluid inlets through which a flow of processing: fluid is received; and an electrode assembly located within the process bowl in a fluid flow path of the fluid received through the one or more fluid inlets, the electrode assembly comprising a mesh electrode through which processing fluid may flow, and first and second diffusers disposed in the fluid flow path proximate the mesh electrode to assist in optimizing the conditions under which processing fluid is in contact with the mesh electrode.

49. A reactor for processing a microelectronic workpiece comprising:

a processing bowl having one or more fluid inlets through which a flow of processing fluid is received; and an electrode assembly located within the process bowl in a fluid flow path of the fluid received through the one or more fluid inlets, the electrode assembly comprising:

a mesh electrode through which processing fluid may flow;

a first diffuser disposed in the fluid flow path prior to the mesh electrode to tailor the flow of processing fluid received from the one or more fluid inlets through the mesh electrode; and a second diffuser disposed between the mesh electrode and the workpiece to tailor the flow of the processing fluid traveling between the mesh electrode and the workpiece.

50. A reactor for processing a microelectronic workpiece comprising:

a processing bowl having one or more fluid inlets through which a flow of processing fluid is received; and an electrode assembly located within the process bowl in a fluid flow path of the fluid received through the one or more fluid inlets, the electrode assembly comprising a mesh electrode through which processing fluid may flow;

a support assembly having an outer circumference which extends proximate to an internal surface of the processing bowl to thereby direct a substantial portion of the fluid from the one or more fluid inlets toward the mesh electrode; and a diffuser disposed in the fluid flow path prior to the mesh electrode to tailor the flow of processing fluid received from the one or more fluid inlets through the mesh electrode.

51. A reactor for processing a microelectronic workpiece comprising:

a processing bowl having one or more fluid inlets through which a flow of processing fluid is received; and an electrode assembly located within the process bowl in a fluid flow path of the fluid received through the one or more fluid inlets, the electrode assembly comprising a mesh electrode comprising a plurality of mesh layers offset from one another to define interstitial regions through which the processing fluid may flow; and a diffuser disposed in the fluid flow path prior to the mesh electrode to tailor the flow of processing fluid received from the one or more fluid inlets through the mesh electrode.

52. An electrode assembly for use in processing a microelectronic workpiece comprising:

a mesh electrode through which processing fluid may flow;

a first diffuser disposed proximate to the mesh electrode to tailor the flow of processing fluid flowing to the mesh electrode; and a second diffuser located proximate the mesh electrode to tailor the flow of processing fluid flowing from the mesh electrode.

53. An electrode assembly for use in processing a microelectronic workpiece comprising:

a mesh electrode through which processing fluid may flow;

a diffuser disposed proximate to the mesh electrode to tailor the flow of processing fluid flowing to the mesh electrode; and a support assembly that is coupled to the mesh electrode and dimensioned to direct substantially all of the processing fluid toward the mesh electrode and limit the amount of processing fluid flowing around the mesh electrode toward a microelectronic workpiece being processed.

54. An electrode assembly for use in processing a microelectronic workpiece comprising:

a mesh electrode comprising a plurality of mesh layers offset from one another to define interstitial regions through which processing fluid may flow; and a diffuser disposed proximate to the mesh electrode to tailor the flow of processing fluid flowing to the mesh electrode in a predetermined manner.

55. An electrode assembly for use in processing a microelectronic workpiece comprising:

a mesh electrode through which processing fluid may flow, and a diffuser disposed beneath the mesh electrode to tailor a flow of processing fluid flowing upwardly to the mesh electrode.

* * * * *

UNITED STATES PATENT AND TRADEMARK OFFICE

CERTIFICATE OF CORRECTION

PATENT NO. : 6,544,391 B1
DATED : April 8, 2003
INVENTOR(S) : Peace

It is certified that error appears in the above-identified patent and that said Letters Patent is hereby corrected as shown below:

Column 10,
Line 29, delete period between "directed" and "through";
Line 39, "diffusor" should be -- diffuser --
Line 52, "another, This" should be -- another. This --;

Column 13,
Line 56, insert -- in -- before "accordance";

Signed and Sealed this

Nineteenth Day of August, 2003

JAMES E. ROGAN
*Director of the United States Patent and Trademark Office*